US009657528B2

(12) United States Patent
Nguyen

(10) Patent No.: US 9,657,528 B2
(45) Date of Patent: May 23, 2017

(54) FLOW BYPASS COMPENSATOR FOR SEALED BEARING DRILL BITS

(71) Applicant: PDB Tools, Inc., Grapevine, TX (US)

(72) Inventor: Nam Duy Nguyen, Lewisville, TX (US)

(73) Assignee: PDB TOOLS, INC., Grapevine, TX (US)

( * ) Notice: Subject to any disclaimer, the term of this patent is extended or adjusted under 35 U.S.C. 154(b) by 194 days.

(21) Appl. No.: 14/525,588

(22) Filed: Oct. 28, 2014

(65) Prior Publication Data

US 2016/0115739 A1 Apr. 28, 2016

(51) Int. Cl.

*E21B 10/22* (2006.01)
*E21B 10/18* (2006.01)
*E21B 10/24* (2006.01)

(52) U.S. Cl.

CPC ..... *E21B 10/18* (2013.01); *E21B 10/24* (2013.01)

(58) Field of Classification Search

CPC ..... E21B 10/22
USPC ..... 175/337, 371, 228, 339
See application file for complete search history.

(56) References Cited

U.S. PATENT DOCUMENTS 930,759 A 8/1909 Hughes
3,365,247 A * 1/1968 Ferrand ..... E21B 10/246 175/227
3,463,270 A * 8/1969 Lundstrom ..... E21B 10/24 175/228
3,844,364 A * 10/1974 Crow ..... E21B 10/246 175/228
4,276,946 A 7/1981 Millsapps, Jr.
4,386,668 A * 6/1983 Parish ..... E21B 10/246 175/228
5,012,876 A * 5/1991 Bruchmiller ..... E21B 10/18 175/318
5,040,624 A 8/1991 Schumacher et al.
6,206,110 B1 * 3/2001 Slaughter, Jr. ..... E21B 10/003 175/227
6,405,811 B1 * 6/2002 Borchardt ..... E21B 10/23 175/227
6,513,607 B2 * 2/2003 Peterson ..... E21B 10/25 175/337
6,619,412 B2 * 9/2003 Slaughter, Jr. ..... E21B 10/003 175/228
7,665,547 B2 2/2010 Yong et al.
(Continued)

*Primary Examiner* — Kenneth L Thompson
(74) *Attorney, Agent, or Firm* — Mark W Handley; Handley Law Firm, PLLC

(57) ABSTRACT

An earth boring bit with sealed cutter bearings has lubricant flow passages which extend from an interior cavity of the bit body to spaces located between bearing shafts and rotary cutters. A lubricant compensator has an elongate body defined by a tube which has a first end disposed in one of the flow passages and a second end which extends into the interior cavity. A piston is initially disposed in the second end, biased to apply pressure to lubricant located in the flow passages. The first end has a section for receiving the piston when lubricant is expelled from within the tube. Apertures extend through a sidewall of the tube, spaced apart from the section in the first end and in fluid communication with the flow passages. The apertures, the flow passages, and the spaces located between bearing shafts and rotary cutters are sized for passing drilling fluid.

19 Claims, 6 Drawing Sheets

(56) References Cited

U.S. PATENT DOCUMENTS

| | | | | |
|---|---|---|---|---|
| 7,975,782 | B2 * | 7/2011 | Peterson | E21B 10/24 175/227 |
| 8,347,986 | B2 | 1/2013 | Anderele | |
| 8,448,726 | B2 | 5/2013 | Ganz | |
| 8,579,046 | B2 | 11/2013 | Crawford et al. | |
| 8,834,026 | B2 * | 9/2014 | Flores | E21B 10/23 175/371 |

* cited by examiner

FLOW BYPASS COMPENSATOR FOR SEALED BEARING DRILL BITS

TECHNICAL FIELD OF THE INVENTION

The present invention relates in general to earth boring drill bits, and in particular to an air flow bypass for use with a lubricator compensator in sealed bearing drill bits.

BACKGROUND OF THE INVENTION

Earth penetrating tools include the rotatable cutter-type earth boring drill bit, such as a rolling cone rock bit. Rolling cone earth boring bits have a bit body with an upper end adapted for connection to a drill string and typically three bit legs which extend downward from the body. Depending from the lower portion of the bit body are a plurality of support arms, typically three in number. A bearing shaft extends inward and downward from each bit leg. A conventional rock bit bearing shaft is cylindrical and rotatably receives a cutter cone. The cutter cone is generally mounted on each bearing shaft and supported rotatably on bearings acting between the spindle and the inside of a spindle-receiving cavity in each cutter cone. The cutter cones have teeth or compacts on their exteriors for disintegrating earth formations as the cones rotate on the bearing shafts. One or more fluid nozzles are often formed on the underside of the bit body. The nozzles are typically positioned to direct drilling fluid passing downwardly from the drill string toward the bottom of the borehole being drilled. Drilling fluid washes away material removed from the bottom of the borehole and cleanses the cutter cones, carrying the cuttings and other debris radially outward and then upward within an annulus defined between the drill bit and the wall of the borehole.

There are several varieties of bearing systems used to support the cutter cones. These bearing systems typically consist of a combination of radial and thrust bearings that may be either sealed and lubricated, or unsealed and open to the drilling fluid, such as air. Contact wear surfaces for bearing shafts may consist of wear-resistant metals or non-metals such as tungsten carbide. In sealed bearing drill bits, seals which are placed across gaps between the cutter cones and respective bearing shafts to prevents debris from contaminating the bearing and also block the lubricant from leaking to the exterior. Various types of seals have been used, including elastomeric seals and metal-to-metal face seals. Open bearing drill bits operate without a seal, and often pass drilling fluids through the cutter bearings for cooling and lubrication. Open bearings often have ports to force drilling fluid through the bearing system to lubricate and cool bearing wear surfaces. In some instances air may be used for the drilling fluid and driven through the bearing to cool and to lubricate the bearings.

When operated in a borehole filled with liquid, hydrostatic pressure acts on the drill bit as a result of the weight of the column of drilling fluid. Temperature increases in the lubricant from heat transfer as the bit is lowered into the well and due to friction heat while rotating causes expansion of the lubricant. A sealed, grease-lubricated bearing drill bit contains a lubricant reservoir in the bit body that supplies lubricant to the bearing shafts. Each bearing shaft has a pressure compensation system that is mounted in the lubricant reservoirs in the bit body. Sealed bearing drill bits commonly use lubrication systems that include a lubricant pressure compensator to limit the pressure differential between the lubricant and the pressure in the borehole. A typical lubricant compensator includes a flexible diaphragm or a spring biased piston separating a lubricant reservoir and the lubricant from the borehole fluid. The diaphragm or spring biased piston moves in response to the pressure differential across it tending to equalize the pressure differential between the lubricant reservoir pressure and the borehole fluid pressure. A lubricant flow passage extends from the reservoir of the compensator to an exterior portion of the bearing shaft. The pressure compensation system has a communication port that communicates with the hydrostatic pressure on the exterior to equalize the pressure on the exterior with lubricant pressure in the passages and clearances within the drill bit. The viscous lubricant creates hydrodynamic lift as the cone rotates on the bearing shaft so that the load is partially supported by lubricant fluid film and partially by surface asperity to surface asperity contact.

Sealed bearing drill bit failures typically occur due to cutter bearing seals wearing until damaged and then the bearings fail before the cutting structure wears out. It is desired to extend the life of sealed bearing drill bits beyond the life of the seals.

SUMMARY OF THE INVENTION

A novel lubricant compensator with an air flow bypass for sealed bearing drill bits is disclosed. An earth boring drill bit has a bit body and downwardly extending legs. Bearing pins or shafts extend inward and downward for mounting rotary cutters. Seals are provided between the bearing shafts and the cutters. Lubricant flow passages extend from an interior cavity of the bit body, through the legs and the bearing shafts, and into the spaces located between the bearing shafts and the cutters. A lubricant compensator extends from the flow passage into the cavity with an open end in which a piston is secured, biased to apply pressure to lubricant located within the flow passages. The compensator has an elongate tube with an inward end disposed within the flow passage and having a section for receiving the piston when lubricant is expelled from within the tube. Perforations extend through the sidewall of the tube, spaced apart from the end by the cavity, in fluid communication with the flow passages.

DESCRIPTION OF THE DRAWINGS

For a more complete understanding of the present invention and the advantages thereof, reference is now made to the following description taken in conjunction with the accompanying Drawings in which

FIG. 1 is a perspective view of the earth boring drill bit having rotary cutters;

FIG. 2 is a perspective view of the drill bit, with the bit body shown in a one-quarter longitudinal section view;

FIG. 3 is a partial section view of the earth boring bit configured for operating in a sealed bearing mode;

FIG. 4 is a partial section view of the earth boring bit configured for operating in an open bearing mode;

FIG. 5 is an exploded view of a lubricant compensator with bypass ports;

FIG. 6 is a perspective view of the lubricant compensator tube;

DETAILED DESCRIPTION OF THE INVENTION

Figure 1:
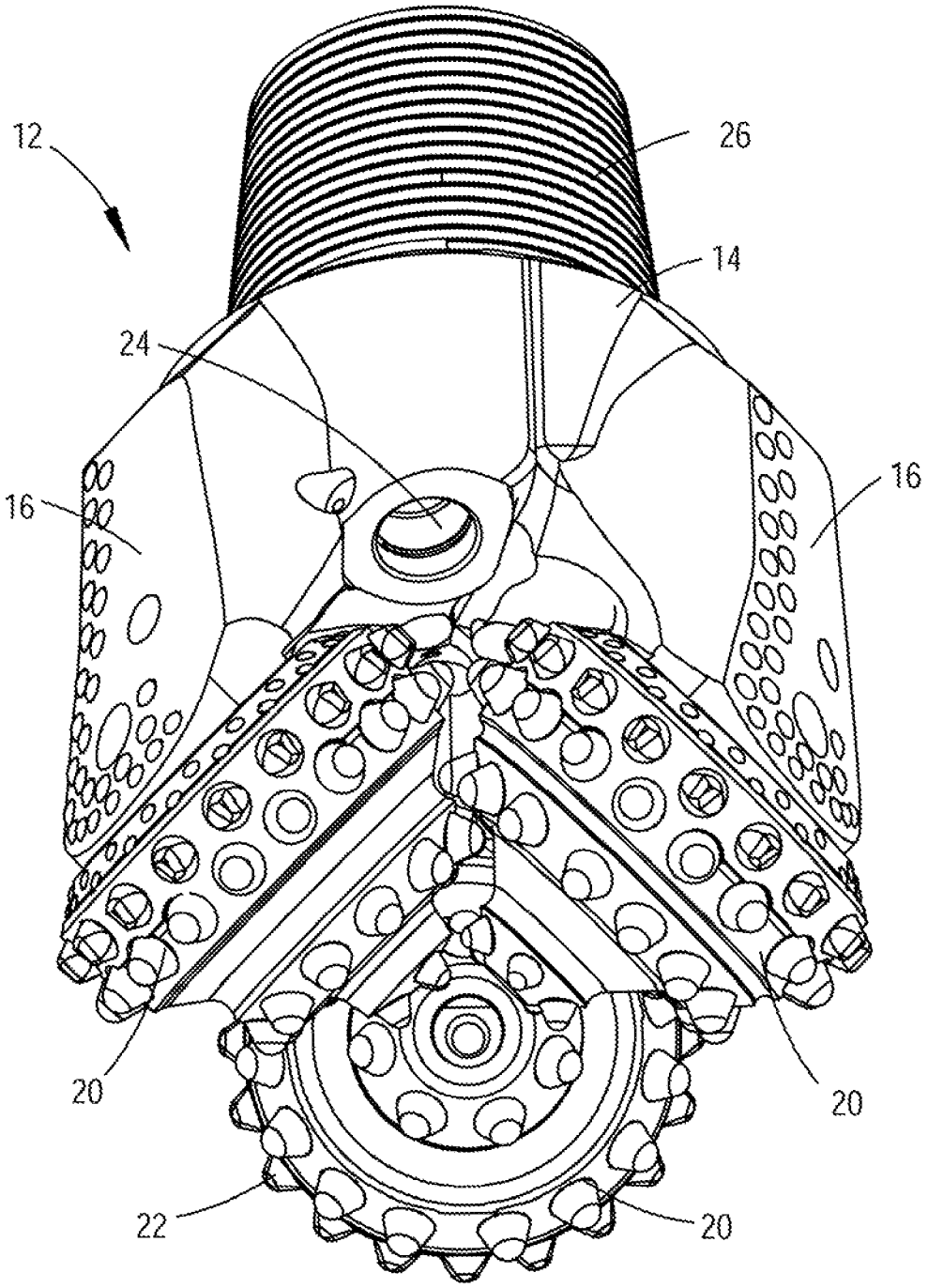
FIGS. 1 through 6 show various aspects for an earth boring drill bit having an air flow bypass for a lubricant compensator made according to the present disclosure, as set forth below.

FIG. 1 is a perspective view of the earth boring bit 12 having a bit body 14 and at least one depending leg 16, with three legs 16 shown. Rotary cutters 20 are rotatably mounted to the legs 16 by means of bearing shafts 18 (shown in FIG. 3). The cutters 20 are shown having insert type teeth 22, preferably tungsten carbide inserts ("TCI"), but other types of cutting teeth such as steel teeth or and abrasive surfaces may be used. The teeth 22 are preferably either tungsten carbide inserts or steel teeth. A nozzle bore 24 is provided in the lower end of the bit body 14 for receiving a flow nozzle and passing drilling fluid onto the cutters 20. The bit body 14 has a bit connection end 26 for connecting to a drill string.

Figure 2:
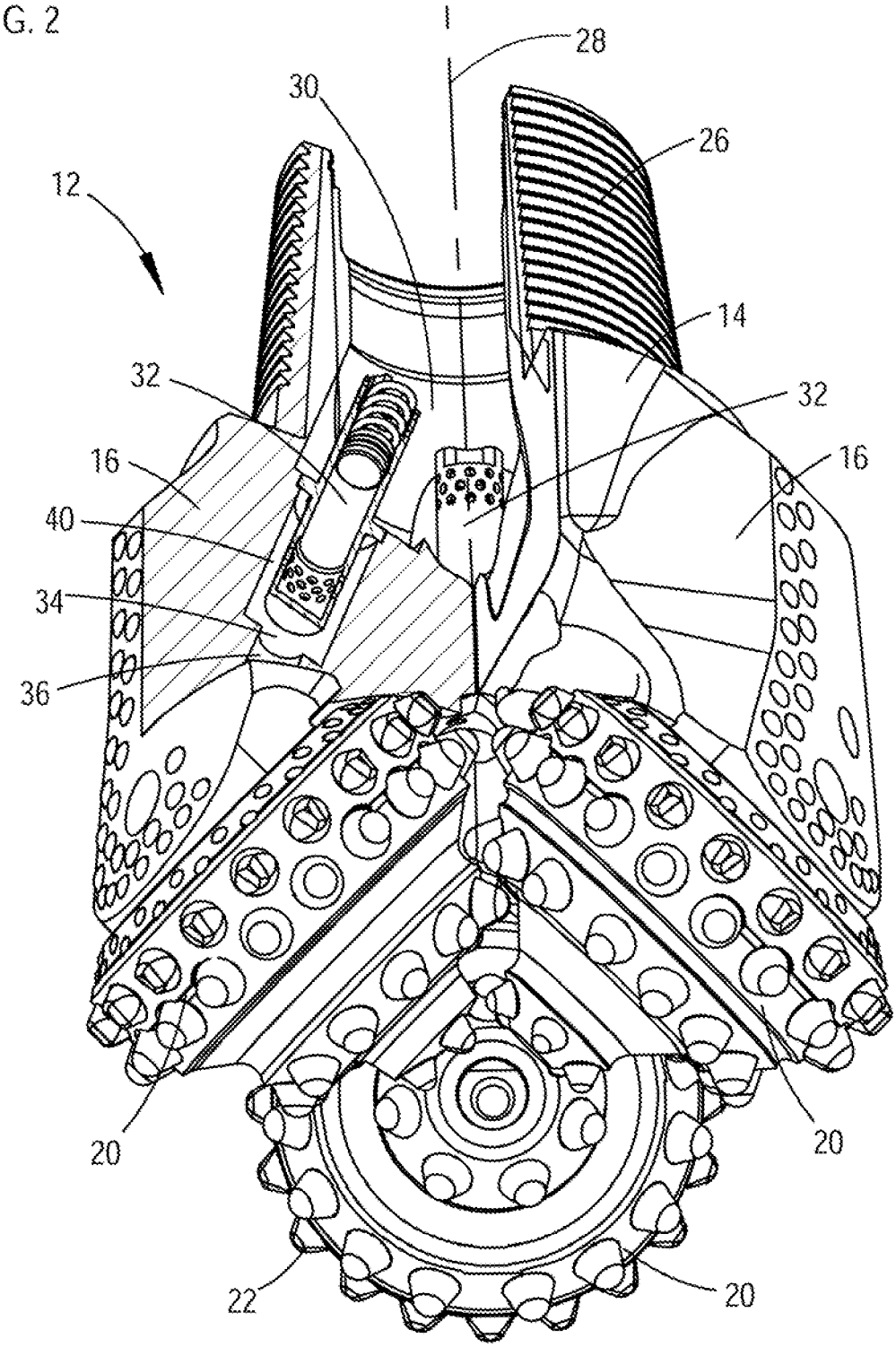

FIG. 2 is perspective view of the drill bit 12, with the bit body 14 shown in a one-quarter longitudinal section view. The bit body 14 has central longitudinal axis 28. An interior cavity 30, or bit bowl, extends into the bit body 14 and is connected to the bore of a drill string for receiving drilling fluid which passes through the bit body 14 for cooling the drill bit 12, cleaning cuttings from cutters 20, and circulating upwards through the borehole with the cuttings. Lubricant pressure compensators 32 (two shown) are mounted in the bit body 14, one for each of the legs 16. The compensators 32 extend from the interior cavity 30 into respective lubricant bores 34 which are flow chambers that are in fluid communication with flow passages 36, which are defined by long air holes or grease holes. An annular space 40 is defined by clearances which extends between the walls of the lubricant bores or flow chambers 34 and the exterior of the compensators 32.

Figure 3:
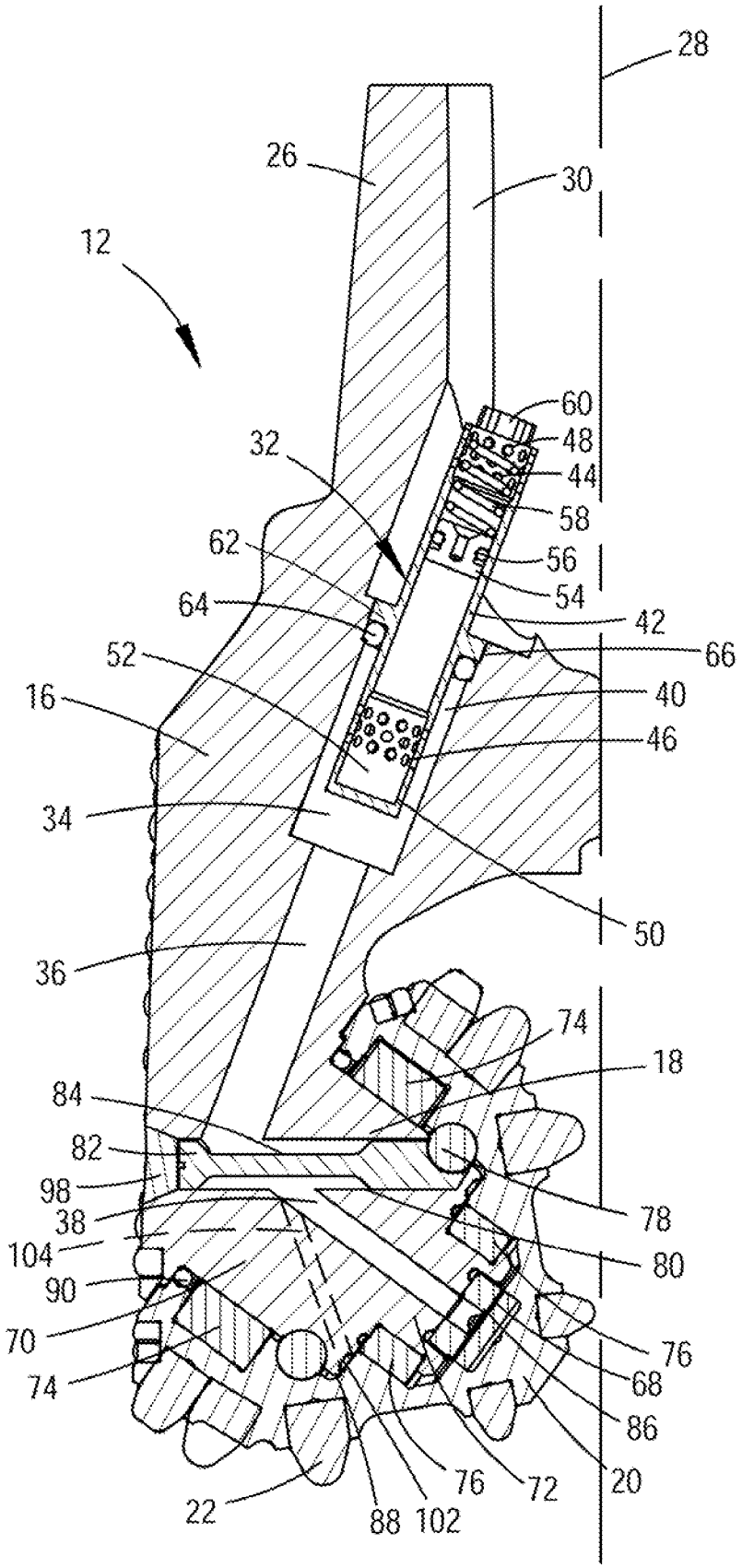
Figure 4:
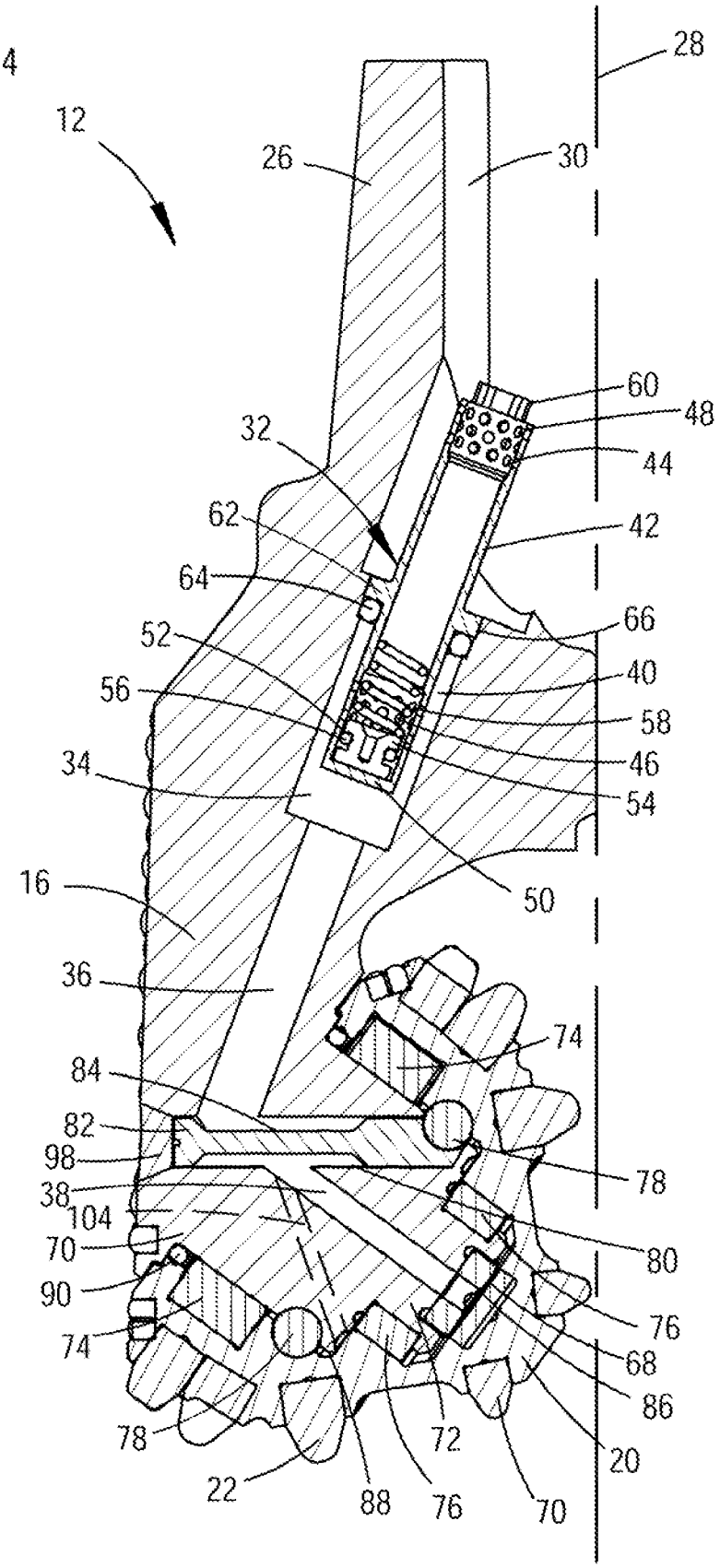

FIGS. 3 and 4 are partial section views of the earth boring bit 12, with FIG. 3 showing the bit 12 configured for operating in a sealed bearing mode and FIG. 4 showing the bit 12 configured for operating in an open bearing mode. The lubricant bore or flow chamber 34 extends from the interior cavity 30 to the flow passage 36. The flow passage 36 extends from the bore 34 to the ball port 80. A flow passage 38 is defined by a pilot hole which extends from the ball port 80 to the terminal end of the bearing shaft 18 located at a thrust bearing 86. The bore 34 and the compensator 32 are sized to provide the annular space 40 there-between. The annular space provides a flow path for fluid flow from the compensator 32 into the bore 34.

The compensator 32 has preferably cylindrical shape, tubular body defined by a tube 42. The compensator tube 42 has opposite end portions define by an open end 48 and a closed end 50. The open end 48 is disposed in the interior cavity 30 and has apertures preferably defined by perforations 44 which extend circumferentially around the tube 42, adjacent to the open end 48. The crimped opening in the open end 48 of the tube 42 and the perforations 44 are both in fluid communication with the interior cavity 30, and provide fluid communication between the interior cavity 30 and an interior of the tube 42 at the tube end section defined by the open end 48. The closed end 50 is disposed to extend into the lubricant bore 34 and has apertures 46 preferably defined by perforations which extend circumferentially around the tube 42, spaced apart from the closed end 50 by a section 52. The section 52 preferably has a tubular shaped interior profile which is sized of a diameter and with a longitudinal length for receiving a piston 54, such that the piston 54 is disposed aside of the apertures 46 such that fluid flow from the open end 42 and the perforations 44 to the apertures 46 is not prevented by the piston 54, as shown in FIG. 4.

The piston 54 is slidably disposed within the tube 42 and has a piston seal 56 preferably provided by an O-ring. A groove circumferentially extends around the piston 54 and, in combination with the interior surface of the tube 42, defines a seal gland for receiving the piston seal 56. A coil spring 58 provides a bias member disposed between the piston 54 and the open end of the tube 42. The open end 48 of the tube 42 is preferably crimped to define a retainer member 60 for securing piston 54 and the coil spring 58 within the tube 42. A flange 62 preferably extends circumferentially around an intermediate portion of the tube 42, located between the open end 48 and the closed end 50. The perforations 44 are preferably disposed between the open end 48 and the shoulder 62 and provide fluid communication between the lubricant bore 34 and the interior of the tube 42. The apertures 46 are preferably disposed between the closed end 50 and the shoulder 62 and provide fluid communication between the lubricant bore 34 and the interior of the tube 42. The flange 62 is preferably welded at the opening of the lubricant bore 34 to the compensator tube 42 to the bit body 14. A recess 66 may be provided to countersink the outward opening of the lubricant bore, or the flow chamber 34 for receiving the flange 62. The flange 62 is preferably continuously extending about a periphery of the compensator tube 42, but in some embodiments may be provide by tabs which protrude radially outward from an exteriors surface of the tube. When the flange 62 does not continuously extend about a circumference of the tube 42, a seal 64 may be provided by an O-ring for sealing between the exterior of the tube 42 and the lubricant bore 34. The seal 64 may be omitted when the weld between the flange 62 and the opening of the lubricant bore 34 provide a fluid tight seal.

The bearing shaft 18 provides a spindle on which the rotary cutter 20 is rotatably mounted. The shaft 18 preferably has a main portion 70 and a pilot portion 72. The outer bearings 74 are provided on the main portion 72, preferably provided by roller bearings Inner bearings 76 are provided on the pilot portion 72 of the shaft 18, preferably provided by roller bearings. Ball bearings 78 lock the cutters 20 onto the bearing shafts 18 in conventional fashion, with a ball plug 82 welded into the ball port 78 to retain the ball bearings 78 between the bearing races of the shaft 18 and the cutter 20. The ball plug 82 has a tapered portion 84 for fluid to flow from the flow passage 36 to the flow passage 38 in the ball port 80. A thrust bearing 86 is located at the outward end of the bearing shaft 18. An intermediate space 88 is located between the bearing shaft 18 and the cutter 20, provided by clearances between the shaft 18 and the cutter 20. The outer bearings 74, the inner bearings 76, the ball bearings 78 and the thrust bearing 86 are located within the intermediate space 88. A seal 90 extends between the bearing shaft 18 and the cutter 20 to seal the intermediate space 88 located there-between. The seal 90 may be provided by an elastomeric member, such as an O-ring, a metal-to-metal seal, or other type seals, such as oval or flat seals preferably formed of an elastomer.

Figure 5:
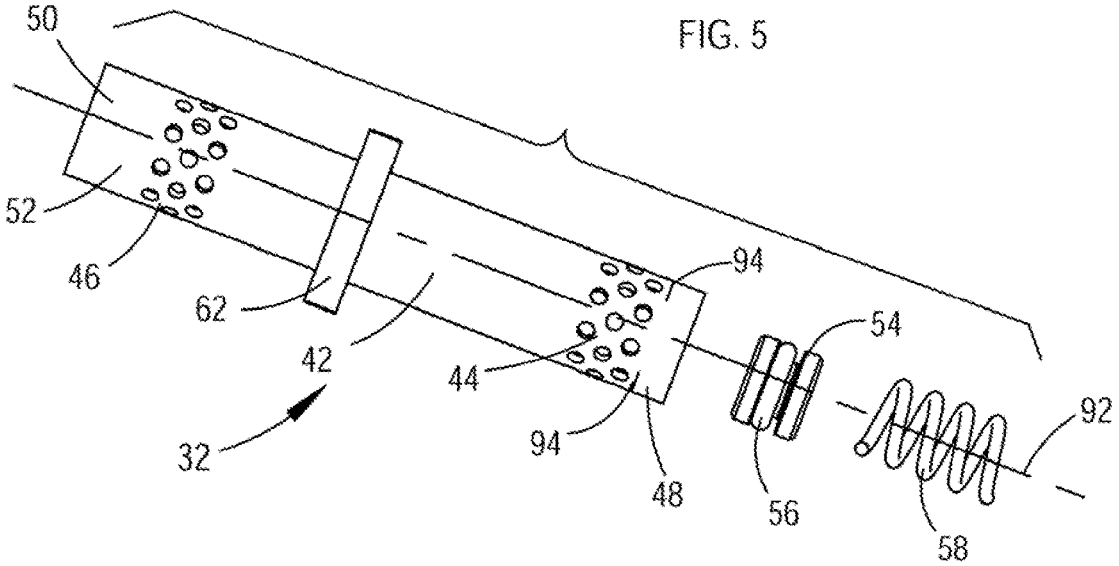

FIG. 5 is an exploded view of a lubricant compensator 32, showing the compensator tube 42, the piston 54 with piston seal 56, and the bias member provided by the coil spring 58. The piston 54, piston seal 56 and coil spring 58 are slidably received within the tube 42. The perforations 44 are shown located at the open end of the tube 48, and the apertures 46 are shown spaced apart from the closed end 50 by the section 52. The shoulder 62 protrudes intermediate between the open end 48 and the perforations 44, and the closed end 50 and the apertures 46. Two slots 94 are disposed between the open end 48 and the perforations 44, and extend partially through opposed sides of the tube 42.

Figure 6:
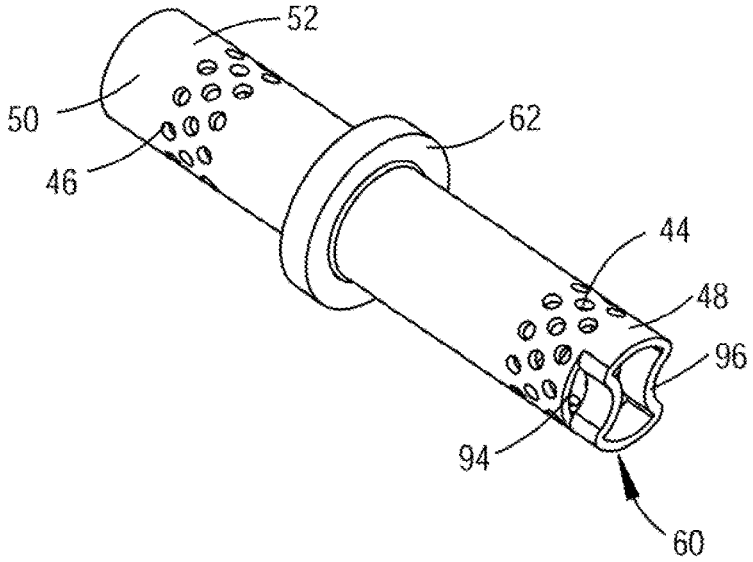

FIG. 6 is perspective view for the lubricant compensator 32, showing the two opposed sides of the tube 42 after being pressed together to define a crimp 96 which defines the retaining member 60 for securing the piston 54 and spring 58 within the tube 42.

Figure 7:
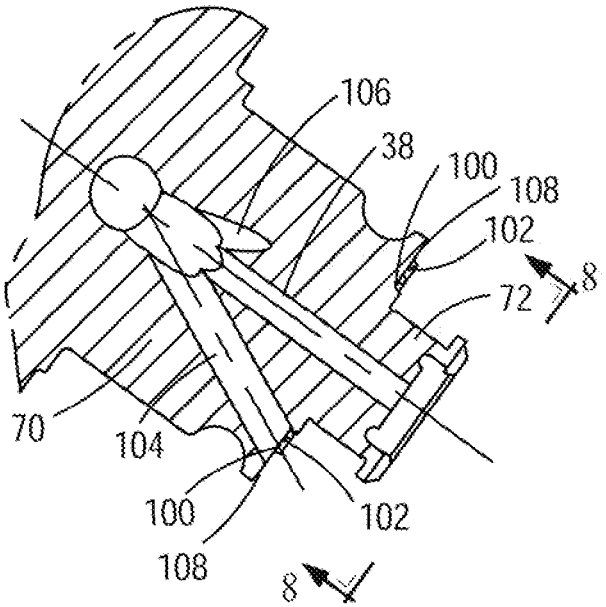
FIG. 7 is a sectional view of the bearing shaft of FIGS. 3 and 4, taken along a section plane which is rotated about the longitudinal axis 28 from the views shown in FIGS. 3 and 4.

FIG. 7 is a sectional view of the bearing shaft 18 of FIGS. 3 and 4, taken along a section plane which is rotated about the longitudinal axis 28 from the views shown in FIGS. 3 and 4. The flow passage 204 extends from the flow passage 38 and through the main portion 70 of the bearing shaft flats 108 for passing fluid to the portion of the space 88 adjacent the inner bearings 76. A second flow passage 106 extends from the flow passage 38 to the second flat 108. A hard facing 102 is disposed in a groove 102 extending into an annular-shaped end face for the main portion 70 of the shaft 18.

Figure 8:
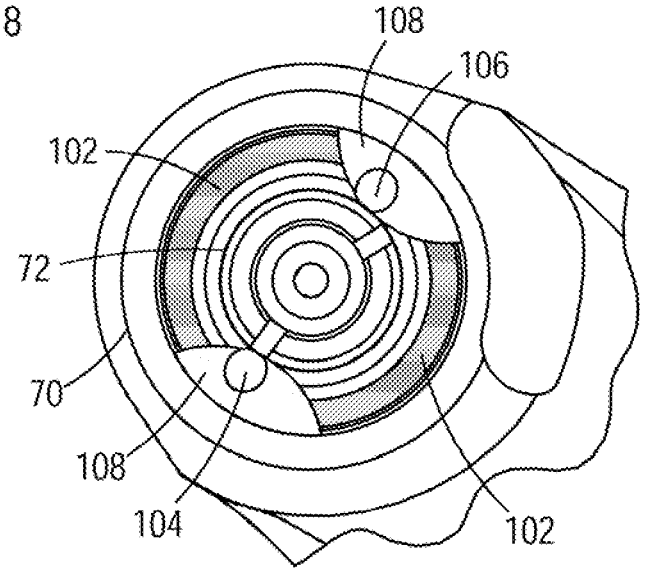
FIG. 8 is an end view of the bearing shaft, taken along the section plane 8-8 of FIG. 7.

FIG. 8 is an end view of the bearing shaft 18, taken along the section plane 8-8 of FIG. 7. The hard facing 102 is shown disposed on an annular-shaped end surface of the main portion 70 of the bearing shaft 18, adjacent a base portion of the pilot bearing portion 72 of the shaft 18. Two flats 108 are shown disposed on opposite sides to the pilot bearing portion 72. The terminal ends of the flow passages 104 and 106 are shown disposed in the flats 108. The flats 108 are milled in the annular shaped end portion of the outer bearing portion, on opposite sides of the pilot portion 72 of the bearing shaft 18. The flats 108 provide clearance for providing the intermediate space 88 for passing lubricants and later well fluids between a rotary cutter 20 and the bearing shaft 18.

The drill bit 12 is initially operated in sealed bearing mode shown in FIG. 3, with lubricant filling the lubricant bore 34, the flow passages 36 and 38, and the compensator tube 42, which together provide a lubricant reservoir. The piston 54 and the piston seal 56 together provide a moveable seal member which is located in a first position. The piston 54, the piston seal 56, and the bias spring 58 will together preferably provide a pressure force to the lubricant which applies approximately forty to seventy pounds per square inch fluid pressure over that of the borehole pressure adjacent to the bit 12. After drilling the seal 90 wears to failure, at which time the lubricant is evacuated from within the compensator tube 42, being pressed outward of the intermediate space 88 and the seal 90. Pressure in the interior cavity 30 will push the piston 54 from the first position, adjacent the open end 48, to a second position located in the section 52 and disposed adjacent to the closed end 50, disposed aside of the apertures 46. Then, the bit 12 will then operate in open bearing mode. This allows drilling fluid to flow in a bypass flow path extending from the interior cavity 30, through the compensator 32 and the apertures 46, and into the lubricant bore 34. The drilling fluid will then flow through the flow passage 36 and the flow passage 38, and then will pass through the intermediate space 88 and the region where the seal 90 was disposed to the borehole. The compensator 32 thus has a bypass flow passage for passing drilling fluids through the lubricant flow passages 36 and 38, and the intermediate spaces 88 to allow the sealed bearing drill bit 12 to be operated in an open bearing mode after failure of the primary cutter bearing seals.

The drilling fluid is preferably air, but other water based or oil based drilling fluids may be used as well. It should be noted that the cross-sectional areas of the lubricant bore 34, the flow passages 36 and 38, and the compensator tube 42 are sized for passing an adequate amount of the drilling fluids to provide proper cooling of the bit 12. The cross-sectional area of the lubricant bore is preferably sized to provide the annular space 40 with sufficient size for passing the proper amount of drilling fluids. Similarly, the open end 48 in combination with the perforations 44 and the apertures 46 are sized for passing this flow of drilling fluids without excessive pressure losses.

The present invention provides advantages of an earth boring drill bit which is first operable in a sealed bearing mode. Once the seals fail, the bit is operated in open bearing mode using the drilling fluids for cooling the drill bit. Air is preferably used as the drilling fluid, but water based and oil based drilling fluids may be used as well.

Although the preferred embodiment has been described in detail, it should be understood that various changes, substitutions and alterations can be made therein without departing from the spirit and scope of the invention as defined by the appended claims.

What is claimed is:

1. An earth boring bit comprising:

a bit body;

at least one bearing shaft mounted to the bit body;

a rotary cutter mounted for rotation on the bearing shaft, defining an intermediate space located there-between;

a seal disposed between the bearing shaft and the rotary cutter for sealing the intermediate space from an exterior of the bit;

a flow passage extending through said bit body, from an interior cavity of the bit body to said intermediate space located between the bearing shafts and the rotary cutters;

a compensator having a first end disposed in communication with said flow passage and a second end disposed in communication with the interior cavity;

at least one aperture extending between an interior of said compensator and said flow passage; and a moveable seal member disposed in said interior of said compensator for at least initially being disposed in a first position, biased to apply pressure to a lubricant disposed in said flow passage and prevent fluid flow through a flow path extending between said interior cavity of the bit body and said flow passage, and wherein said moveable seal member is disposed in a second position within said compensator when the lubricant is expelled from said compensator and when disposed in said second position said moveable seal member is located aside of said flow path for passing fluid flow from said interior cavity of the bit body to said flow passage below the compensator.

2. The earth boring bit according to claim 1, wherein perforations in said first end of said compensator, said flow passage, and said spaces located between the bearing shaft and the rotary cutter are sized for passing drilling fluid.

3. The earth boring bit according to claim 2, wherein said drilling fluid is air.

4. The earth boring bit according to claim 1, further comprising:

said passage through said bit body having a terminal end portion disposed adjacent to said interior cavity, wherein said terminal end portion is enlarged over a cross-sectional size of other portions of said lubricant flow passage to define a flow chamber; and wherein said flow chamber is sized for receiving said first end of said compensator with a clearance disposed between said compensator and said flow chamber and said clearance is sized for passing said fluid flow from said interior cavity of the bit body to said lubricant flow passage.

5. The earth boring bit according to claim 4, wherein said compensator has a flange which outwardly extends from an intermediate portion of said compensator, and said flange engages said terminal end portion of said flow passage for locating said compensator in said flow chamber.

6. The earth boring bit according to claim 5, wherein said flange is welded to said bit body to fixedly secure said first end of said compensator within said flow chamber.

7. The earth bearing bit according to claim 5, wherein an elastomeric seal is disposed between said flow chamber and said compensator for sealingly engaging there-between.

8. An earth boring bit comprising:

a bit body;

at least one bearing shaft mounted to the bit body;

a cutter mounted for rotation on the bearing shaft, defining an intermediate space located there-between;

a seal disposed between the bearing shaft and the rotary cutter for sealing the intermediate space from an exterior of the bit;

a lubricant flow passage extending from an interior cavity of the bit body to said intermediate space located between the bearing shafts and the rotary cutters;

a compensator having an elongate body defined by a tube, said tube having a first end disposed in said lubricant flow passage and a second end which extends into the interior cavity, wherein an interior of said second end of said tube is in fluid communication with the interior cavity;

a piston is initially disposed in said second end of said tube, biased to apply pressure to a lubricant disposed in said flow passage;

said first end of said tube having a section for receiving said piston when the lubricant is expelled from within the tube;

apertures extend through a sidewall of the tube, spaced apart from said section and in fluid communication with said flow passage; and wherein said interior of said second end, said tube, said flow passage, and said spaces located between the bearing shaft and the rotary cutter are sized for passing drilling fluid.

9. The earth boring bit according to claim 8, wherein said drilling fluid is air.

10. The earth boring bit according to claim 8, further comprising:

said lubricant flow passage through said bit body having a terminal end portion disposed adjacent to said interior cavity, wherein said terminal end portion is enlarged over a cross-sectional size of other portions of said lubricant flow passage to define a flow chamber; and wherein said flow chamber is sized for receiving said first end of said compensator with a clearance disposed between said compensator and said flow chamber and said clearance is sized for passing said fluid flow from said interior cavity of the bit body to said lubricant flow passage.

11. The earth boring bit according to claim 10, wherein said compensator has a flange which outwardly extends from an intermediate portion of said compensator, and said flange engages said terminal end portion of said flow passage for locating said compensator in said flow chamber.

12. The earth boring bit according to claim 11, wherein said flange is welded to said bit body to fixedly secure said first end of said compensator within said flow chamber.

13. The earth bearing bit according to claim 10, wherein an elastomeric seal is disposed between said flow chamber and said compensator for sealingly engaging there-between.

14. An earth boring bit comprising:

a bit body;

at least one bearing shaft mounted to the bit body;

a cutter mounted for rotation on the bearing shaft, defining an intermediate space located there-between;

a seal disposed between the bearing shaft and the rotary cutter for sealing the intermediate space from an exterior of the bit;

a lubricant flow passage extending from an interior cavity of the bit body to said intermediate space located between the bearing shafts and the rotary cutters;

a compensator having an elongate body defined by a tube, said tube having a first end disposed in said lubricant flow passage and a second end which extends into the interior cavity, wherein said second end of said tube has perforations which are in fluid communication with the interior cavity;

a piston is initially disposed in said second end of said tube, biased to apply pressure to a lubricant disposed in said flow passage;

said first end of said tube having a section for receiving said piston when the lubricant is expelled from within the tube;

apertures extend through a sidewall of the tube, spaced apart from said section and in fluid communication with said flow passage; and wherein said perforations, said interior of said second end, said tube, said flow passage, and said spaces located between the bearing shaft and the rotary cutter are sized for passing drilling fluid.

15. The earth boring bit according to claim 14, wherein said drilling fluid is air.

16. The earth boring bit according to claim 14, further comprising:

said lubricant flow passage through said bit body having a terminal end portion disposed adjacent to said interior cavity, wherein said terminal end portion is enlarged over a cross-sectional size of other portions of said lubricant flow passage to define a flow chamber; and wherein said flow chamber is sized for receiving said first end of said compensator with a clearance disposed between said compensator and said flow chamber and said clearance is sized for passing said fluid flow from said interior cavity of the bit body to said lubricant flow passage.

17. The earth boring bit according to claim 16, wherein said compensator has a flange which outwardly extends from an intermediate portion of said compensator, and said flange engages said terminal end portion of said flow passage for locating said compensator in said flow chamber.

18. The earth boring bit according to claim 17, wherein said flange is welded to said bit body to fixedly secure said first end of said compensator within said flow chamber.

19. The earth bearing bit according to claim 16, wherein an elastomeric seal is disposed between said flow chamber and said compensator for sealingly engaging there-between.

* * * * *